US012734579B2

(12) United States Patent
Hirao et al.

(10) Patent No.: US 12,734,579 B2
(45) Date of Patent: Sep. 15, 2026

(54) METHOD OF PREPARING METAL PARTICLE DISPERSION

(71) Applicant: NEW-TECH CORPORATION, Kyoto (JP)

(72) Inventors: Kazuyuki Hirao, Kyoto (JP); Qiang Gong, Kyoto (JP); Kohji Nagashima, Kyoto (JP); Kazunori Yamashita, Kyoto (JP); Takeshi Fujiwara, Kyoto (JP)

(73) Assignee: NEW-TECH CORPORATION, Kyoto (JP)

( * ) Notice: Subject to any disclaimer, the term of this patent is extended or adjusted under 35 U.S.C. 154(b) by 345 days.

(21) Appl. No.: 18/669,459

(22) Filed: May 20, 2024

(65) Prior Publication Data

US 2024/0390976 A1 Nov. 28, 2024

(30) Foreign Application Priority Data

May 23, 2023 (JP) ..... 2023-084873

(51) Int. Cl.
*B22F 1/145* (2022.01)
*B22F 1/054* (2022.01)

(52) U.S. Cl.
CPC ..... *B22F 1/147* (2022.01); *B22F 1/054* (2022.01); *B22F 2301/255* (2013.01); *B22F 2998/10* (2013.01)

(58) Field of Classification Search
CPC .... B22F 1/147; B22F 1/054; B22F 2301/255; B22F 2998/10; B22F 1/102; B22F 1/0545; B22F 9/24; B82Y 40/00
USPC ..... 75/370
See application file for complete search history.

(56) References Cited

U.S. PATENT DOCUMENTS

2017/0304805 A1* 10/2017 Xu ..... B01J 21/04

FOREIGN PATENT DOCUMENTS

JP 2005220435 A 8/2005
JP 2021073379 A 5/2021

* cited by examiner

*Primary Examiner* — Danielle M. Carda
(74) *Attorney, Agent, or Firm* — SZDC Law PC

(57) ABSTRACT

A method of preparing metal particle dispersion includes preparing an ion-containing solution that contains metal ions (step S11), performing heat treatment on a protectant having an average molecular weight of greater than or equal to 5000 and less than or equal to 32500 (step S12), and mixing the aforementioned ion-containing solution, a reducing agent, and the protectant subjected to the heat treatment in step S12 to prepare metal particle dispersion in which metal microparticles are dispersed by a liquid-phase reduction method (step S13). This method achieves improved dispersibility and further fragmentation of the metal microparticles in the metal particle dispersion.

7 Claims, 2 Drawing Sheets

METHOD OF PREPARING METAL PARTICLE DISPERSION

CROSS-REFERENCE TO RELATED APPLICATIONS

This application claims priority benefit of Japanese Patent Application No. 2023-84873 filed in the Japan Patent Office on May 23, 2023, the entire disclosure of which is incorporated herein by reference.

TECHNICAL FIELD

The present invention relates to a method of preparing metal particle dispersion.

BACKGROUND ART

As a method of preparing metal particle dispersion, a liquid-phase reduction method has conventionally been known in which a reduction reaction is caused in a solution that contains metal ions, and resultant metal microparticles are coated with a protectant. Japanese Patent Application Laid-Open No. 2005-220435 (Document 1) discloses the use of an organic high-polymer compound such as a carbon chain compound or a carbon ring compound as the protectant. Japanese Patent Application Laid-Open No. 2021-073379 (Document 2) discloses the use of polyvinyl pyrrolidone, a copolymer that contains vinylpyrrolidone, polyoxymethylene, or the like as a water-soluble polymer suspension stabilizer (protectant).

There is demand for improved dispersibility and further fragmentation of metal microparticles in metal particle dispersion. Meanwhile, a wide range of organic high-polymer compounds are usable as the aforementioned protectant, and it is not really clear what kind of a protectant is suited to achieve improved dispersibility and further fragmentation of metal microparticles.

SUMMARY OF THE INVENTION

The present invention is intended for a method of preparing metal particle dispersion, and it is an object of the present invention to achieve improved dispersibility and further fragmentation of metal microparticles in metal particle dispersion.

An first aspect of the present invention is a method of preparing metal particle dispersion that includes a) preparing an ion-containing solution that contains metal ions, b) performing heat treatment on a protectant having an average molecular weight of greater than or equal to 5000 and less than or equal to 32500, and c) mixing the ion-containing solution, a reducing agent, and the protectant subjected to the heat treatment in the operation b) to prepare metal particle dispersion in which metal microparticles are dispersed by a liquid-phase reduction method.

According to the present invention, it is possible to achieve improved dispersibility and further fragmentation of metal microparticles in metal particle dispersion.

A second aspect of the present invention is the method of preparing metal particle dispersion according to the first aspect, in which the metal microparticles are silver microparticles.

A third aspect of the present invention is the method of preparing metal particle dispersion according to the second aspect, in which the protectant is polyvinyl pyrrolidone.

A fourth aspect of the present invention is the method of preparing metal particle dispersion according to the third aspect, in which the protectant has a K-value of greater than or equal to 12.0 and less than or equal to 27.0.

A fifth aspect of the present invention is the method of preparing metal particle dispersion according to the second aspect, in which the reducing agent is triethanolamine.

A sixth aspect of the present invention is the method of preparing metal particle dispersion according to any one of the first to fifth aspects, in which a heating temperature in the heat treatment is higher than or equal to 100° C. and lower than or equal to 150° C.

A seventh aspect of the present invention is the method of preparing metal particle dispersion according to any one of the first to fifth aspects (or any one of the first to sixth aspects), in which the metal microparticles in the metal particle dispersion prepared in the operation c) have an average particle diameter of less than or equal to 10 nm.

These and other objects, features, aspects and advantages of the present invention will become more apparent from the following detailed description of the present invention when taken in conjunction with the accompanying drawings.

DETAILED DESCRIPTION

Figure 1:
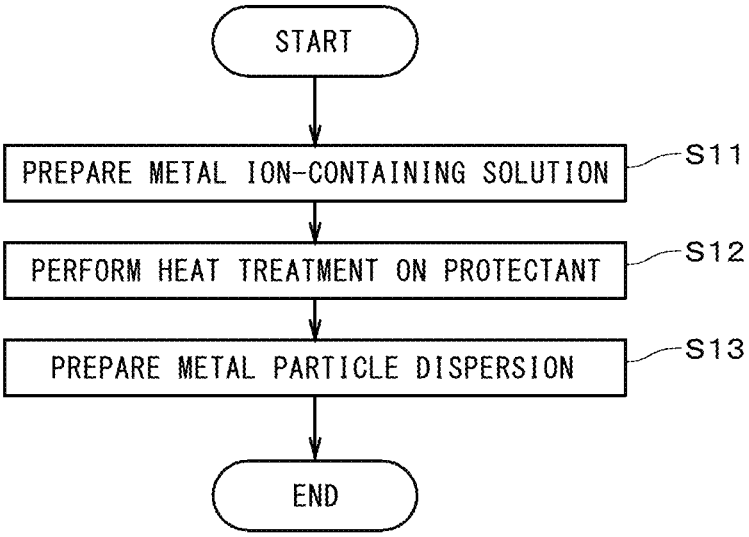
FIG. 1 is a flowchart showing the preparation of metal particle dispersion according to one embodiment.

FIG. 1 is a flowchart showing the preparation of metal particle dispersion according to one embodiment of the present invention. The metal particle dispersion is a liquid in which metal microparticles are dispersed. The microparticles are nanoparticles having particle diameters of less than 1 μm. The metal may, for example, be any one or a combination of any two or more of silver (Ag), gold (Au), copper (Cu), platinum (Pt), ruthenium (Ru), rhodium (Rh), and iridium (Ir).

For example, the metal particle dispersion may be supplied to a laser-fragmentation-in-liquid (LFL) device. In this device, metal microparticles in metal particle dispersion are further fragmented into smaller particles by irradiating the metal microparticle dispersion with laser.

In the case of preparing the metal particle dispersion, firstly, a solution that contains metal ions (hereinafter, also referred to as a "metal ion-containing solution") is prepared (step S11). For example, in step S11, the metal ion-containing solution is prepared by adding powder metal salt to a solvent with agitation. As the metal salt, for example, nitrate, sulfate, acetate, or sodium chloride may be usable. As the solvent, for example, glycerin, ethanol, or isopropanol may be usable. The temperature at the time of agitation may be in the range of, for example, 20° C. to 60° C., and the agitation time may be in the range of, for example, one hour to three hours. There are no particular limitations on the concentration of metal ions in the metal ion-containing solution as long as metal ions are dissolvable in the solvent, and the concentration of metal ions may be in the range of, for example, 0.5 mass % to 6 mass %.

Then, heat treatment is performed on a protectant (step S12). As the protectant, an organic high-polymer compound may be usable and, for example, polyvinyl pyrrolidone (PVP), polyethylene glycol (PEG), or polyvinyl alcohol (PVA) may be favorably used. Before the heat treatment in step S12, the protectant may have an average molecular weight of greater than or equal to 5000, preferably greater than or equal to 7000, and more preferably greater than or equal to 10000. The average molecular weight may also be less than or equal to 32500, preferably less than or equal to 30000, and more preferably less than or equal to 24500. The average molecular weight of the protectant is obtained by gel permeation chromatography (GPC). GPC is also called size exclusion chromatography (SEC).

In the case of using PVP as the protectant, the PVP before the heat treatment in step S12 may have a K-value of, for example, greater than or equal to 12.0 and preferably greater than or equal to 13.9. The K-value of PVP before the heat treatment may also be, for example, less than or equal to 27.0 and preferably less than or equal to 25.9. The aforementioned K-value is a viscosity characteristic value correlated with the molecular weight and is obtained by applying a relative viscosity value measured at 25° C. by a capillary viscosimeter to the Fikentscher equation (Expression 1) below. In Expression 1, $\eta_{rel}$ represents the viscosity of the PVP relative to water in an aqueous solution, and c represents the concentration (%) of the protectant in the PVP aqueous solution.

$$K = (1.5\log\eta_{rel} - 1)/(0.15 + 0.003c) + \left(300c\cdot\log\eta_{rel} + (c + 1.5c\cdot\log\eta_{rel})^2\right)^{1/2}/\left(0.15c + 0.003c^2\right) \quad \text{(Expression 1)}$$

The temperature of heating the protectant in step S12 may, for example, be higher than or equal to 100° C. and preferably higher than or equal to 120° C. The heating temperature may also be, for example, lower than or equal to 150° C. and preferably lower than or equal to 130° C. The heating time of heating the protectant in step S12 may, for example, be 10 hours or more and preferably 18 hours or more. The heating time may also, for example, be 24 hours or less and preferably 20 hours or less.

The powder protectant heated in step S12 is added to a solvent with agitation so as to prepare a solution that contains the protectant (hereinafter, also referred to as a "protectant-containing solution"). As the solvent, for example, glycerin, ethanol, or isopropanol may be usable. The temperature at the time of agitation may be in the range of, for example, 20° C. to 60° C., and the agitation time may be in the range of, for example, one hour to three hours. There are no particular limitations on the concentration of the protectant in the protectant-containing solution as long as the protectant is dissolvable in the solvent, and the concentration of the protectant may be in the range of, for example, 10 mass % to 20 mass %. Note that step S12 may be performed in parallel with or before step S11.

After steps S11 and S12 are completed, the metal ion-containing solution, the protectant-containing solution (i.e., the solution containing the heated protectant), and a reducing agent are mixed into a mixed solution. As the reducing agent, for example, triethanolamine (TEA), monoethanolamine, diethanolamine, N,N-dimethyl ethanolamine, monopropanolamine, 2-amino-2-methyl-1-propearl, dipropanolamine, or tripropanolamine may be usable. For example, the reducing agent may be mixed with the metal ion-containing solution and the protectant-containing solution as a reducing agent-containing solution in which the reducing agent is dissolved in a solvent. As the solvent, for example, glycerin, ethanol, or isopropanol may be usable.

Then, metal ions in the aforementioned mixed solution are reduced to metal microparticles by agitation of the mixed solution, and surfaces of the metal microparticles are coated with the protectant. This suppresses flocculation and precipitation of the metal microparticles and allows preparation of metal particle dispersion in which the metal microparticles are dispersed (step S13). That is, the metal particle dispersion is prepared by the liquid-phase reduction method in step S13. The temperature at the time of the aforementioned agitation of the mixed solution may be in the range of, for example, 40° C. to 90° C., and the agitation time may be in the range of, for example, one hour to four hours. The metal particle dispersion prepared in step S13 is cooled and/or diluted as necessary.

The metal microparticles contained in the metal particle dispersion may have an average particle diameter of, for example, less than or equal to 10 nm and preferably less than or equal to 5 nm. There are no particular limitations on the lower limit for the average particle diameter, but the average particle diameter may, for example, be greater than or equal to 1 nm. The average particle diameter is obtained by observing 300 or more metal microparticles within a field of view with an electron microscope and calculating an arithmetical mean of the particle diameters of 150 or more metal microparticles among the 300 or more metal microparticles. That is, the average particle diameter corresponds to the particle diameter of the metal microparticles whose surfaces are coated with the protectant.

Next, examples of the metal particle dispersion according to the invention of the present application and comparative examples will be described with reference to Table 1 given below. In Examples 1 to 6, metal particle dispersion was prepared by the method shown in steps S11 to S13 described above. In Comparative Examples 1 to 4, metal particle dispersion was prepared by steps S11 and S13 without performing step S12 described above. That is, in Comparative Examples 1 to 4, heat treatment was not performed on the protectant, and the protectant that had not undergone heat treatment was mixed with an ion-containing solution and a reducing agent-containing solution in step S13.

TABLE 1

| | Protectant | | | | Average Particle | |
|---|---|---|---|---|---|---|
| | Name | Average Molecular Weight | K-value | Heating Temperature (° C.) | Diameter of Metal Microparticles (nm) | Precipitation (Day) |
| Example 1 | PVP K15 | 10000 | 12.0-18.0 | 100 | 12.2 | 7 |
| Example 2 | PVP K15 | 10000 | 12.0-18.0 | 110 | 10.5 | 10 |

TABLE 1-continued

| | Protectant | | | | Average Particle | |
|---|---|---|---|---|---|---|
| | Name | Average Molecular Weight | K-value | Heating Temperature (° C.) | Diameter of Metal Microparticles (nm) | Precipitation (Day) |
| Example 3 | PVP K15 | 10000 | 12.0-18.0 | 120 | 9.2 | 10< |
| Example 4 | PVP K15 | 10000 | 12.0-18.0 | 125 | 6.6 | 10< |
| Example 5 | PVP K15 | 10000 | 12.0-18.0 | 130 | 5.4 | 10< |
| Example 6 | PVP K25 | 24500 | 23.0-27.0 | 125 | 6.3 | 10< |
| Comparative Example 1 | PVP K15 | 10000 | 12.0-18.0 | No heated | 18.6 | 3 |
| Comparative Example 2 | PVP K25 | 24500 | 23.0-27.0 | Not heated | 13.0 | 10< |
| Comparative Example 3 | PVP K30 | 40000 | 26.0-34.0 | Not heated | 19.2 | 10< |
| Comparative Example 4 | PVP K12 | 3500 | 10.2-13.8 | Not heated | Not generated | — |

In Example 1, the metal ion-containing solution was prepared by adding powder silver nitrate to glycerin with agitation in step S11. The temperature at the time of agitation was 40° C., and the agitation time was one hour. The concentration of silver ions in the metal ion-containing solution was about 3 mass %.

In step S12, heat treatment was performed on PVP by heating powder PVP in a constant-temperature bath. The temperature of heating the PVP in the heat treatment was 100° C., and the heating time was 24 hours. As the PVP described above, "PVP K15" manufactured by Tokyo Chemical Industry Co., Ltd. was used. Note that the PVP before the heat treatment had a K-value of 12.0 to 18.0 according to catalog values given by Tokyo Chemical Industry Co., Ltd. The average molecular weight of the PVP before the heat treatment was 10000.

The average molecular weight was measured by GPC as described above. In the measurement of the average molecular weight by GPC, "Shodex RI-71 (manufactured by SHOWA DENKO K.K.) was used as a detector, "Shodex OHpack SB-806M HQ×2 (manufactured by SHOWA DENKO K.K.) was used as a column, and "LC-10ADvp (manufactured by Shimadzu Corporation)" was used as a pump. As a standard polymer, polyethylene oxide and polyethylene glycol were used.

The aforementioned protectant-containing solution was prepared by adding the PVP that has undergone the heat treatment to glycerin with agitation. The temperature at the time of agitation was 90° C., and the agitation time was one hour. The concentration of the PVP in the protectant-containing solution was about 20 mass %.

In step S13, triethanolamine (TEA) was used as a reducing agent. The temperature at the time of agitation of the mixed solution in step S13 was 90° C., and the agitation time was one hour. In the metal particle dispersion prepared in step S13, silver microparticles (so-called silver nanoparticles) had particle diameters of 5 nm to 20 nm and had an average particle diameter of 12.2 nm. The average particle diameter of the metal microparticles was obtained by a method similar to the method described above. In the measurement of the average particle diameter, a spherical-aberration-corrected transmission electron microscope (JEM-2200FS produced by JEOL Ltd.) was used as an electron microscope. As a result of maintaining the metal particle dispersion in a resting state, precipitation occurred on the seventh day after the preparation.

Example 2 is similar to Example 1, except that the temperature of heating the PVP in step S12 was 110° C. In Example 2, silver microparticles in the metal particle dispersion had particle diameters of 5 nm to 20 nm and had an average particle diameter of 10.5 nm. As a result of maintaining the metal particle dispersion in a resting state, precipitation occurred on the tenth day after the preparation.

Example 3 is similar to Example 1, except that the temperature of heating the PVP in step S12 was 120° C. In Example 3, silver microparticles in the metal particle dispersion had particle diameters of 5 nm to 20 nm and had an average particle diameter of 9.2 nm. As a result of maintaining the metal particle dispersion in a resting state, precipitation did not occur even after 10 or more days.

Figure 2:
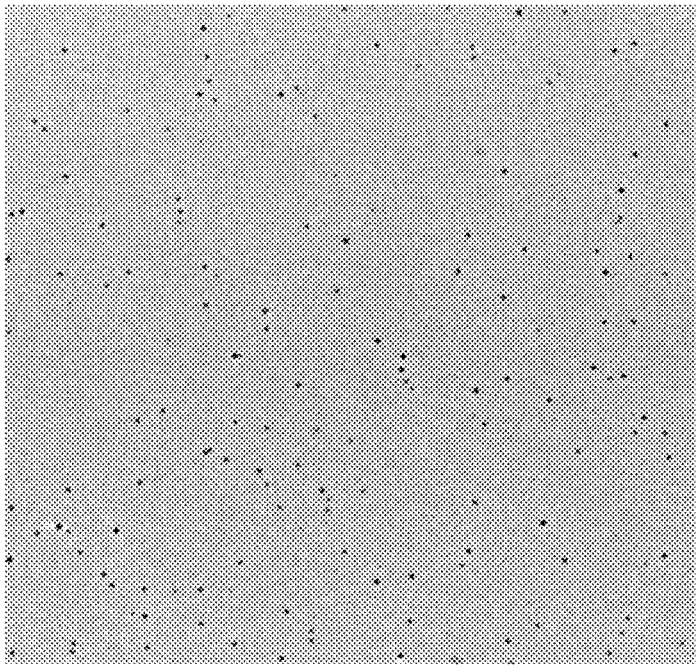
FIG. 2 is a diagram showing silver microparticles contained in the metal particle dispersion according to an example.

Example 4 is similar to Example 1, except that the temperature of heating the PVP in step S12 was 125° C. In Example 4, silver microparticles in the metal particle dispersion had particle diameters of 5 nm to 15 nm and had an average particle diameter of 6.6 nm. FIG. 2 shows silver microparticles contained in the metal particle dispersion according to Example 4 and observed with the aforementioned spherical-aberration-corrected transmission electron microscope. The silver microparticles are shown as a plurality of approximately circular black points in FIG. 2 (the same applies to FIG. 3 described later). As a result of maintaining the metal particle dispersion in a resting state, precipitation did not occur even after 10 or more days. A subsequent follow-up study of the metal particle dispersion according to Example 4 showed that precipitation did not occur even after one year or more.

Example 5 is similar to Example 1, except that the temperature of heating the PVP in step S12 was 130° C. In Example 5, silver microparticles in the metal particle dispersion had particle diameters of 5 nm to 15 nm and had an average particle diameter of 5.4 nm. As a result of maintaining the metal particle dispersion in a resting state, precipitation did not occur even after 10 or more days.

Example 6 is similar to Example 4, except that "PVP K25" manufactured by Nacalai Tesque, Inc. was used as the PVP. In Example 6, the PVP that was not heated had an average molecular weight of 24500. The average molecular weight was measured by GPC in the same manner as in Example 1. The PVP before the heat treatment had a K-value of 23.0 to 27.0 according to catalog values given by Nacalai Tesque, Inc. In Example 6, silver microparticles in the metal particle dispersion had particle diameters of 5 nm to 20 nm and had an average particle diameter of 6.3 nm. As a result of maintaining the metal particle dispersion in a resting state, precipitation did not occur even after 10 or more days.

Comparative Example 1 is similar to Example 1, except that the heat treatment in step S12 was not performed on the PVP. In Comparative Example 1, silver microparticles in the metal particle dispersion had particle diameters of 10 nm to 80 nm and had an average particle diameter of 18.6 nm. The average particle diameter of the silver microparticles in Comparative Example 1 was apparently greater than the average particle diameters in Examples 1 to 5. As a result of maintaining the metal particle dispersion in a resting state, precipitation occurred on the third day after the preparation. This shows that the metal particle dispersion according to Comparative Example 1 had lower dispersibility of silver microparticles than the metal particle dispersions according to Examples 1 to 5.

Comparative Example 2 is similar to Example 6, except that the heat treatment in step S12 was not performed on the PVP. In Comparative Example 2, silver microparticles of the metal particle dispersion had particle diameters of 5 nm to 25 nm and had an average particle diameter of 13.0 nm. The average particle diameter of the silver microparticles in Comparative Example 2 was apparently greater than the average particle diameter in Example 6. As a result of maintaining the metal particle dispersion in a resting state, precipitation did not occur even after 10 or more days.

Comparative Example 3 is similar to Comparative Example 1, except that "PVP K30" manufactured by Tokyo Chemical Industry Co., Ltd. was used as the PVP. In Comparative Example 3, the PVP that was not heated had an average molecular weight of 40000. The average molecular weight was measured by GPC in the same manner as in Example 1. The PVP before the heat treatment had a K-value of 26.0 to 34.0 according to catalog values given by Tokyo Chemical Industry Co., Ltd.

Figure 3:
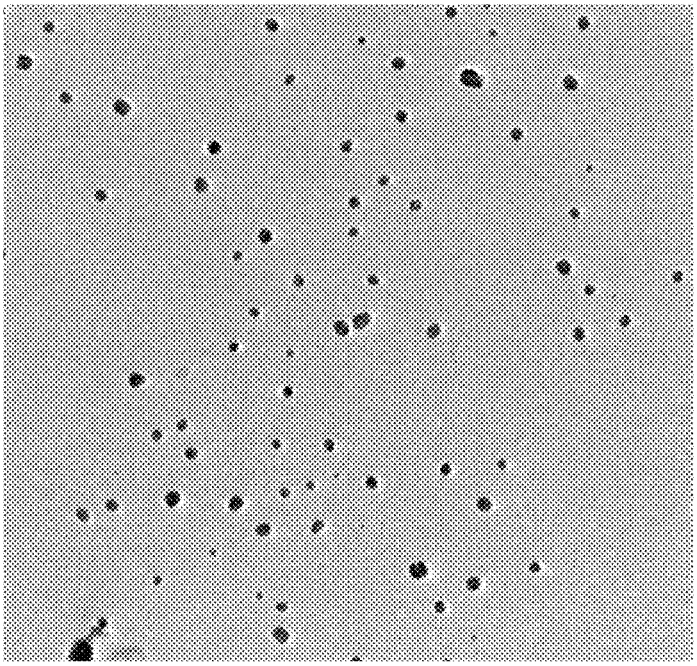
FIG. 3 is a diagram showing silver microparticles contained in metal particle dispersion according to a comparative example.

In Comparative Example 3, silver microparticles in the metal particle dispersion had particle diameters of 10 nm to 50 nm and had an average particle diameter of 19.2 nm. FIG. 3 shows silver microparticles that are contained in the metal particle dispersion according to Comparative Example 3 and observed with the aforementioned spherical-aberration-corrected transmission electron microscope. Comparison of FIGS. 2 and 3 shows that the particle diameters of the silver microparticles according to Example 4 shown in FIG. 2 were apparently smaller than the particle diameters of the silver microparticles according to Comparative Example 3 shown in FIG. 3. In Comparative Example 3, as a result of maintaining the metal particle dispersion in a resting state, precipitation did not occur even after 10 or more days. In the case where "PVP K30" according to Comparative Example 3 was used in the preparation of the metal particle dispersion in steps S11 to S13 described above, silver microparticles had a greater average particle diameter than in Comparative Example 3.

Comparative Example 4 is similar to Comparative Example 1, except that "PVP K12" manufactured by ACROS Co., Ltd. was used as the PVP. In Comparative Example 4, the PVP that was not heated had an average molecular weight of 3500. The average molecular weight was measured by GPC in the same manner as in Example 1. The PVP before the heat treatment had a K-value of 10.2 to 13.8 according to catalog values given by ACROS Co., Ltd. In Comparative Example 4, silver microparticles were not generated in step S13. Similarly, in the case where "PVP K12" according to Comparative Example 4 was used in steps S11 to S13 described above, silver microparticles were not generated in step S13.

Figure 4:
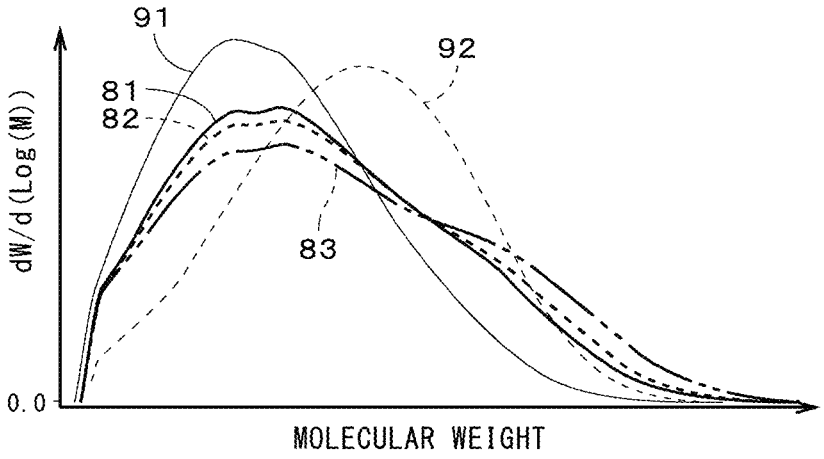
FIG. 4 is a diagram showing molecular-weight distribution curves.

FIG. 4 is a diagram showing differential molecular-weight distribution curves obtained by GPC described above for the PVP according to each of Examples 2, 3, and 5 and Comparative Examples 1 and 3. For Examples 2, 3, and 5, FIG. 4 shows the molecular-weight distribution curve of the PVP after the heat treatment in step S12. For Comparative Examples 1 and 3, FIG. 4 shows the molecular-weight distribution curve of the PVP that was not heated. In FIG. 4, the molecular-weight distribution curves corresponding to Examples 2, 3, and 5 are respectively given reference signs 81, 82, and 83, whereas the molecular-weight distribution curves corresponding to Comparative Examples 1 and 3 are respectively given reference signs 91 and 92.

As shown in FIG. 4, peak top molecular weights at the top ends of the molecular-weight distribution curves corresponding to Examples 2, 3, and 5 in which heat treatment (step S12) was performed on the PVP were greater than a peak top molecular weight in Comparative Example 1 in which heat treatment was not performed on the PVP. Thus, it is conceivable that the metal particle dispersions according to Examples 2, 3, and 5 exhibit higher dispersibility of silver microparticles than the metal particle dispersion according to Comparative Example 1. Besides, the peak top molecular weights in Examples 3 and 5 were greater than the peak top molecular weight in Example 2. Thus, it is conceivable that the metal particle dispersions according to Examples 3 and 5 had higher dispersibility of silver microparticles (no precipitation) than the metal particle dispersion according to Example 2 (in which precipitation occurred on the 10th day after the preparation). Moreover, the peak top molecular weights in Examples 2, 3, and 5 were less than the peak top molecular weight in Comparative Example 3 in which the average molecular weight before the heat treatment was 40000. Thus, it is conceivable that silver microparticles in the metal particle dispersions according to Examples 2, 3, and 5 had smaller average particle diameters than in Comparative Example 3.

As described thus far, the method of preparing metal particle dispersion includes the step of preparing an ion-containing solution that contains metal ions (step S11), the step of performing heat treatment on a protectant having an average molecular weight of greater than or equal to 5000 and less than or equal to 32500 (step S12), and the step of mixing the aforementioned ion-containing solution, a reducing agent, and the protectant heated in step S12 to prepare metal particle dispersion in which metal microparticles are dispersed by a liquid-phase reduction method (step S13). The method achieves improved dispersibility and further fragmentation of metal microparticles in the metal particle dispersion. From the viewpoint of achieving further improved dispersibility and further fragmentation of metal microparticles in the metal particle dispersion, the aforementioned average molecular weight may preferably be greater than or equal to 7000 (more preferably greater than or equal to 10000) and preferably less than or equal to 30000 (more preferably less than or equal to 24500).

The aforementioned metal microparticles may preferably be silver microparticles. According to the aforementioned method of preparing metal particle dispersion, it is possible to prepare the metal particle dispersion in which silver microparticles having a small average particle diameter are dispersed with high dispersibility.

The aforementioned protectant may preferably be polyvinyl pyrrolidone (PVP). In this case, it is possible to favorably prepare the metal particle dispersion in which silver microparticles having a small average particle diameter are dispersed with high dispersibility. The aforementioned protectant (PVP) may preferably have a K-value of greater than or equal to 12.0 and less than or equal to 27.0.

In this case, it is possible to favorably prepare the metal particle dispersion in which silver microparticles having a small average particle diameter are dispersed with high dispersibility. From the viewpoint of achieving further improved dispersibility and further fragmentation of metal microparticles in the metal particle dispersion, the aforementioned K-value may more preferably be greater than or equal to 13.9 and less than or equal to 25.9.

The aforementioned reducing agent may preferably be triethanolamine. In this case, it is possible to favorably prepare the metal particle dispersion in which silver microparticles having a small average particle diameter are dispersed with high dispersibility.

The heating temperature in the aforementioned heat treatment (step S12) may preferably be higher than or equal to 100° C. and lower than or equal to 150° C. In this case, it is possible to favorably achieve improved dispersibility and further fragmentation of metal microparticles in the metal particle dispersion. More preferably, the heating temperature may be higher than or equal to 120° C. and lower than or equal to 130° C. In this case, it is possible to achieve further improved dispersibility and further fragmentation of metal microparticles in the metal particle dispersion.

As described above, the average particle diameter of metal microparticles in the metal particle dispersion prepared in step S13 may preferably be less than or equal to 10 nm. In this case, it is possible to provide the metal particle dispersion in which metal microparticles having a very small average particle diameter are dispersed.

The aforementioned method of preparing metal particle dispersion may be modified in various ways.

For example, the average particle diameter of the metal microparticles in the metal particle dispersion may be greater than 10 nm.

The temperature of heating the protectant in step S12 may be lower than 100° C. or may be higher than 150° C.

The protectant and the reducing agent are not limited to the examples descried above, and any of a variety of materials may be used instead.

The method of preparing the metal ion-containing solution in step S11 is not limited to the example descried above and may be modified in various ways. The metal type is also not limited to the example described above and may be modified in various ways.

The configurations of the above-described preferred embodiments and variations may be appropriately combined as long as there are no mutual inconsistencies.

While the invention has been shown and described in detail, the foregoing description is in all aspects illustrative and not restrictive. It is therefore understood that numerous modifications and variations can be devised without departing from the scope of the invention.

REFERENCE SIGNS LIST

S11 to S13 step

The invention claimed is:

1. A method of preparing metal particle dispersion, comprising:

a) preparing an ion-containing solution that contains metal ions;

b) performing heat treatment on a protectant having an average molecular weight of greater than or equal to 5000 and less than or equal to 32500; and c) mixing said ion-containing solution, a reducing agent, and said protectant subjected to the heat treatment in said operation b) to prepare metal particle dispersion in which metal microparticles are dispersed by a liquid-phase reduction method.

2. The method of preparing metal particle dispersion according to claim 1, wherein said metal microparticles are silver microparticles.

3. The method of preparing metal particle dispersion according to claim 2, wherein said protectant is polyvinyl pyrrolidone.

4. The method of preparing metal particle dispersion according to claim 3, wherein said protectant has a K-value of greater than or equal to 12.0 and less than or equal to 27.0.

5. The method of preparing metal particle dispersion according to claim 2, wherein said reducing agent is triethanolamine.

6. The method of preparing metal particle dispersion according to claim 1, wherein a heating temperature in said heat treatment is higher than or equal to 100° C. and lower than or equal to 150° C.

7. The method of preparing metal particle dispersion according to claim 1, wherein said metal microparticles in said metal particle dispersion prepared in said operation c) have an average particle diameter of less than or equal to 10 nm.

* * * * *